US006880320B2

(12) United States Patent
Olinger et al.

(10) Patent No.: US 6,880,320 B2
(45) Date of Patent: Apr. 19, 2005

(54) COLOR EFFECT YARN AND PROCESS FOR THE MANUFACTURE THEREOF

(75) Inventors: Harold A. Olinger, Bristol, VA (US); Arnold L. Belcher, Jr., Bristol, TN (US); Lawrence E. Rasnick, Jr., Bristol, VA (US)

(73) Assignee: Prisma Fibers, Inc., Bristol, VA (US)

( * ) Notice: Subject to any disclaimer, the term of this patent is extended or adjusted under 35 U.S.C. 154(b) by 0 days.

(21) Appl. No.: 10/630,712

(22) Filed: Jul. 31, 2003

(65) Prior Publication Data

US 2005/0022493 A1 Feb. 3, 2005

(51) Int. Cl.[7] ..... D02G 3/02
(52) U.S. Cl. ..... 57/228; 57/245; 57/246
(58) Field of Search ..... 57/3, 6, 210, 225–228, 57/243–247; 28/220, 252, 258, 271; 428/364, 370, 373, 375, 377, 378

(56) References Cited

U.S. PATENT DOCUMENTS

| | | | | | |
|---|---|---|---|---|---|
| RE29,352 | E | * | 8/1977 | Newton | 57/246 |
| 4,365,466 | A | * | 12/1982 | Horiuchi et al. | 57/205 |
| RE31,376 | E | * | 9/1983 | Sheehan et al. | 57/208 |
| 4,993,218 | A | * | 2/1991 | Schwartz et al. | 57/208 |
| 5,423,859 | A | * | 6/1995 | Koyfman et al. | 606/228 |
| 5,715,584 | A | * | 2/1998 | Coons et al. | 28/140 |
| 5,804,115 | A | | 9/1998 | Burton et al. | |
| 6,023,926 | A | | 2/2000 | Flynn | |
| 6,085,395 | A | * | 7/2000 | Weiss | 28/221 |
| 6,240,609 | B1 | | 6/2001 | Rasnick et al. | |
| 6,401,315 | B1 | | 6/2002 | Rasnick et al. | |
| 6,536,200 | B1 | | 3/2003 | Schwartz | |

* cited by examiner

*Primary Examiner*—John J. Calvert
*Assistant Examiner*—Shaun R Hurley
(74) *Attorney, Agent, or Firm*—Dykema Gossett PLLC

(57) ABSTRACT

A multicolored effect yarn for use in carpeting includes a core yarn which exhibits substantially zero twist and is formed of a multiplicity of BCF singles yarns, at least one of which has a different color from another, and which are entangled at first and second frequencies of entanglement points and different degrees of entanglements, and a wrapper yarn helically wrapped around the core yarn and has a lower denier than any of the singles yarns.

35 Claims, No Drawings

COLOR EFFECT YARN AND PROCESS FOR THE MANUFACTURE THEREOF

BACKGROUND OF THE INVENTION

Within the floorcoverings industry there is constant demand for yarns that can be woven, knitted or tufted into backing materials that exhibit novel and aesthetically pleasing appearance. In particular, yarns that, when incorporated into carpets, produce random or irregular color changes over a flooring area are very popular.

Space-dyed yarns are traditionally made via a process that involves dyeing yarns to create the effect of the color varying at irregular intervals along the length of the yarn, for example by knit-de-knit or warp printing. Such produced space-dyed yarns can produce a variety of visually appealing effects in carpets. Including well differentiated color points in an unorganised design. However, the processes are slow and inefficient, adding to the high cost of such products, and the dyeing process itself has environmental drawbacks.

Another approach to obtaining novel color effects in a yarn is to combine two or more yarns, hereinafter referred to as singles yarns, into a yarn bundle, hereinafter referred to as the product yarn. In the case where at least one singles yarn differs in color or dyeability from the others, product yarns with a wide variety of effects may be manufactured.

Heather yarns are created by entangling singles yarn individually and collectively, at chosen levels of entanglement, to provide a range of color effects. Heather yarns can, when incorporated into a carpet, produce color effects ranging from well-blended yarns in which a single color is perceived at normal viewing distance from the floor, to various degrees of speckled appearance, when random points of color can be differentiated by the observer at the normal viewing distance. Yarns that come under this category do not feature the same degree of color differentiation as space dyed yarns.

In order to produce yarns that can provide similar aesthetics to space dyed yarns, more sophisticated entanglement processes have been developed for the manufacture of yarns referred to as "mock" or "apparent" space dyed. See, for example U.S. Pat. No. 5,804,115 (Burton et al), and U.S. Pat. No. 6,240,609 and U.S. Pat. No. 6,401,315.

Other approaches to the manufacture of yarns with a similar appearance to space dyed yarns have been made.

U.S. Pat. No. 6,023,926 (Flynn) describes a yarn and process in which two or more singles yarns, where at least one singles yarn differs in color from the others, are false-twisted together at low false twist level to produce a low frequency alteration of the predominant color along the length of the assembly. The false twist is then stabilised by helically wrapping the false-twisted bundle with a very low denier yarn, which itself does not visibly contribute to the appearance of the product yarn.

U.S. Pat. No. 6,536,200 (Schwartz) achieves a similar appearance by separately tensioning two differently colored singles yarns and combining these under controlled varying tension in such a manner that controllable lengths of the bundle show one color predominantly when the singles yarn of the first color is under low tension and the singles yarn of the second color is under high tension, and vice versa. Again, the bundle is helically wrapped with one or more very low denier yarns, or with monofilament(s).

SUMMARY OF THE INVENTION

The present invention relates to multicolored effect yarns for use as tufted, woven or knitted face yarns in textile floorcoverings made from a combination of differently colored, dyed or melt pigmented, singles yarns; a process for the manufacture of such multicolored effect yarns, and a floorcovering whose face yarn consists wholly or partially of such multicolored effect yarns.

A first aspect of the invention relates to a multicolored effect yarn which comprises a core having two or more untwisted bulked continuous fiber (BCF) singles yarns, at least one of which is differently colored than the others, and a single wrapper yarn spirally wrapped around the core, where the wrapper yarn may be differently colored than any of the core singles yarns, or may be the same color as any of the core singles yarns.

A second aspect of the invention relates to a process for the manufacture of a multicolored effect yarn by bringing together two or more BCF singles yarns, at least one of which is differently colored than the others, in such a manner as to impart substantially zero real, cabled, false or apparent twist thereto, and helically wrapping the thus formed core of two or more singles yarns with a wrapper yarn, where the wrapper yarn may be differently colored than any of said singles yarns in said core, or may be the same color as any of the singles yarns in the core.

A third aspect of the invention relates to a carpet comprising, wholly or partially, a plurality of the multicolored effect yarns of the invention tufted, woven or knitted into a backing substrate, and acting as the face of said carpet.

DETAILED DESCRIPTION OF THE INVENTION

The multicolored effect yarn of the invention consists of two essential components; a core comprising a multiplicity of singles yarns, and a wrapper yarn wrapped around the core in a helical manner.

The singles yarns utilised in the core are bulked continuous filament (BCF) yarns manufactured in a draw-texturing process in which the texturing is achieved by means of fluid-jet or mechanical crimping.

In subsequent process steps, the BCF singles yarns are first individually air-jet entangled, interlaced or tacked, at a first degree of entanglement, and secondly the multiplicity of BCF singles yarns forming the core are air-jet entangled at a second, lower, degree of entanglement. Degree of entanglement at the entanglement points along the length of the individual singles yarns, or along the length of the core, may be visually assessed based on the integrity of the entanglement and assigned a value, expressed as a percentage; the higher percentage, the greater the integrity of the entanglement. The degree of entanglement affects the visual appearance of the product yarn.

Each individual singles yarn is air-jet entangled to a degree between about 75% and about 100%, and the individual singles yarns have between about 40 and about 80 entanglement points per meter. Each individual singles yarn has a denier preferably between about 400 and about 1400. The total denier of the core is preferably between about 1200 and about 4800. Preferably there are between about 2 and about 8 of the BCF singles yarns in the core of the multicolored effect yarn. At least one of the individual BCF singles yarns comprising the core is of a different color to the others, and preferably at least two of the individual BCF singles yarns are of contrasting colors, i.e., exhibit colors from opposing regions of color space.

The individual air-jet entangled BCF singles yarns are brought together in a further air-jet entangling, interlacing or tacking process, where the multiplicity of the air-jet entangled BCF singles yarns are air-jet entangled together at a degree of entanglement preferably between about 10% and about 25%. The multiplicity of air-jet entangled BCF singles yarns are air-jet entangled together at between about 1 and about 2 entanglement points per meter.

The core portion of the multicolored effect yarn assembled using the above-described processes is now helically wrapped with a wrapper yarn. The wrapper yarn may be a partially oriented yarn, a flat-drawn yarn or a draw-textured yarn; preferably the wrapper yarn is a partially oriented yarn. In selecting the wrapper yarn for use in the inventive product and process, it is necessary to take into account any likely dimensional changes of the wrapper yarns, especially shrinkage, which might occur during further processing of the thus-formed multicolored effect yarn, for example in heat-setting, or in use of the multicolored effect yarn in the manufacture of a floorcovering. Minimal, dimensional change is required of the wrapper yarn, and one ordinarily skilled in the art will easily be able to select suitable yarns for this process.

The wrapper yarn preferably has a denier of between about 150 and 250, and is of a denier less than that of any of the individual BCF singles yarns present in the core of the multicolored effect yarn. The wrapper yarn may be of a different color to any of the the BCF singles yarns in the core, or may be the same color as one or more of the BCF singles yarns in the core. Utilisation of a wrapper yarn of the above denier range has been found to allow the assembly of a straight, rather than a twisted or cable-appearance, multicolored effect yarn, and also to allow the wrapper yarn to contribute to the aesthetics of the multicolored effect yarn. Twisting or cabling of the core yarns either prior to or during the process has a deleterious effect on the desired appearance of the product yarn and the subsequent carpet produced therefrom.

The wrapping process in which the wrapper yarn is helically wound around the core is carried out on a direct cabling device, and example of which is the "CarpetCabler", manufactured by Volkmann GmbH of Germany. In a standard yarn cabling process, two yarns are processed under balanced tensions and the product yarn has a "double helix" type, cabled or "barber-pole" style configuration. The inventors have found by extensive experimentation, that through the selection of the deniers and types of the core and wrapper yarns and by carefully controlling tensions on the yarns, and further by the degree of helical turns of the wrapper yarn around the core yarn it is possible to produce a stable and balanced product yarn with no residual torque of the desired aesthetic and color appearance in which the core yarn has an essentially straight, untwisted, configuration, with the wrapper yarn helically wound around it.

The core, which exhibits substantially zero twist, is helically wrapped with the wrapper yarn at a level of between about 40 and about 80 turns per meter. The core and wrapper yarns are preferably tensioned at between 150 and 250 grams during the process. Lower tensions tend to result in twisting of the core yarns. The product yarn may then be wound up into a package, using any standard winding apparatus, and can be utilised directly for incorporation, by tufting, weaving or knitting. Into a floorcovering. When tufted with the inventive yarn, carpets are indistinguishable from those incorporating traditional space dyed yarns while having the benefits of superior performance associated with solution-dyed yarns.

The series of processes described above for the manufacture of the inventive multicolored effect yarns can be carried out as a continuous sequential process, or as a discrete series of steps.

The core BCF singles yarns and the wrapper yarn of the inventive multicolored effect yarn may be made form the same or different polymer(s). The polymer(s) are selected form fiber-forming polymers, preferably melt-spinnable polymers.

The melt-spinnable polymers include, but are not limited to, polyamides, polyesters and polyolefins. Non-exclusive examples of the polyamides are nylon 6, nylon 11, nylon 12, nylon 6,6, nylon 6,10, nylon 6,12, and copolymers and blends of same. Non-exclusive examples of the polyesters are poly(ethylene terephthalate), poly(propylene terephthalate), poly(butylene terephthalate), poly (cyclohexane dimethanol terephthalate), poly(ethylene naphthalate), poly(propylene naphthalate), poly(ethylene adipate), poly(ethylene succinate), poly(hydroxybutyrate), poly(lactic acid), and copolymers and blends of same. Non-exclusive examples of the polyolefins are polyethylene, polypropylene, and copolymers and blends of same.

The core BCF singles yarns and the wrapper yarn of the inventive multicolored effect yarn may be colored in the same manner or may be colored in different manner. The manners of coloration include dyeing of pre-spun fibers or yarns, and producer-coloring of the polymer prior to spinning by incorporation of pigments and/or dyes in the polymer melt. Preferably both the BCF singles yarns and the wrapper yarn are colored by incorporation of pigment(s) into the polymer melt ("solution dyed") prior to spinning. With the suitable selection of pigment(s) familiar to those ordinarily skilled in the art, solution dyed yarns have been found to offer superior end-use performance over dyed yarns, e.g., low color fade and better resistance to harsh cleaning methods.

Both the core BCF singles yarns and the wrapper yarn of the inventive multicolored effect yarn may include within the polymer matrix thereof other adjuvants. These adjuvants include, but are not limited to, antioxidants, UV stabilisers, stain-resists, soil-resists, antistats, antimicrobials, lubricants, plasticisers, and process aids.

EXAMPLE 1

Four 600 denier, 30 filaments of trilobal cross-sectional shape, sulfonated nylon 6,6 BCF singles yarns were each individually air-jet entangled with 80 entanglement points per meter, and with a degree of entanglement at the entanglement points of substantially 100%. Each singles BCF yarn had been colored using melt-pigmented to a different shade, the colors being blue, green, red and bronze.

The four singles yarns were then fed, in parallel fashion with substantially zero real or false twist, into a second air-jet entangling process, where they are air-jet entangled together with 2 entanglement points per meter, and a degree of entanglement at the entanglement points of about 20%.

The core yarn is then placed in the direct cabling machine as a first feed yarn. A second feed yarn is set up on the machine as the wrapper component; the second feed yarn comprising a 200 denier, 20 filaments of round cross-sectional shape, sulfonated nylon 6 copolymer partially oriented yarn, which is melt-pigmented to a different color to that of any of the core BCF singles yarns, the color being bright green.

The yarn tensions of both the core and the wrapper yarns were set to 200 grams and the direct cabling process was carried out to produce the multicolored effect yarn of the invention. The product yarn was then wound up onto a tube. The product yarn denier was 2621.

EXAMPLE 2

Five solution dyed 600 denier, 30 filaments of trilobal cross-sectional shape, sulfonated nylon 6,6 BCF singles yarns were processed in a similar manner to that described in Example 1 to produce the core yarn. The five colors were red, light green, dark green, blue and bronze. A solution dyed 200 denier, 20 filaments of round cross-sectional shape, sulfonated nylon 6 copolymer partially oriented yarn was used as the wrapper yarn. The core and wrapper yarns were direct cabled in a similar manner to that described in Example 1. The product yarn denier was 3220.

Both product yarns from Examples 1 and 2 were level-loop tufted to produce carpet that was indistinguishable in appearance to that produced using traditional space-dyed yarns.

While the invention has been described in conjunction with specific embodiments, it is evident that many alternative modifications and variations will be apparent to those skilled in the art. The preferred embodiments of the invention set forth above are not to be construed as limiting the the invention in any manner. Various changes may be incorporated without departing from the spirit and scope of the invention as defined in the claims below.

We claim:

1. A multicolored effect yarn comprising:

a) a core yarn consisting of a multiplicity of bulked continuous filament (BCF) singles yarns having a denier of about 400 to about 1400, wherein at least one of said BCF singles yarns is of a different color than any of the other BCF singles yarns, wherein each BCF singles yarn is individually air-jet entangled at between about 40 and about 80 entanglement points per meter and with a first degree of entanglement at said entanglement points, and wherein said multiplicity of individually air-jet entangled BCF singles yarns are subsequently air-jet entangled together at a second, lower, frequency of entanglement points and with a second, lower, degree of entanglement at said entanglement points, wherein said core yarn exhibits substantially zero twist; and b) a wrapper yarn helically wound around said core yarn, wherein said wrapper yarn is the same or differently colored than any of said multiplicity of said BCF singles yarns in said core yarn, and wherein the denier of said wrapper yarn is less than that of any of said multiplicity of said singles yarns in said core yarn.

2. A multicolored effect yarn according to claim 1, wherein said multiplicity of said BCF singles yarns comprises between 2 and 8 of said BCF singles yarns.

3. A multicolored effect yarn according to claim 1, wherein said individually air-jet entangled BCF singles yarns have a degree of entanglement at said entanglement points of between about 75% and about 100%.

4. A multicolored effect yarn according to claim 3, wherein said multiplicity of air-jet entangled BCF singles yarns are together subsequently air jet entangled at between about 1 and about 2 entanglement points per meter.

5. A multicolored effect yarn according to claim 4, wherein said air-jet entangled multiplicity of said air-jet entangled BCF singles yarns has a degree of entanglement at said entanglement points of between about 10% and about 25%.

6. A multicolored effect yarn according to claim 1, wherein said wrapper yarn is selected from the set of partially oriented yarns, flat drawn yarns and draw-textured yarns.

7. A multicolored effect yarn according to claim 6, wherein said wrapper yarn is a partially oriented yarn.

8. A multicolored effect yarn according to claim 7, wherein said wrapper yarn has a denier of between about 150 and about 250.

9. A multicolored effect yarn according to claim 1, wherein said multiplicity of BCF singles yarns and said wrapper yarn are made from a melt-spinnable polymer selected from the group consisting of polyamides, polyesters and polyolefins.

10. A multicolored effect yarn according to claim 9, wherein said polyamide is selected from the group consisting of nylon 6, nylon 11, nylon 12, nylon 6,6, nylon 6,10, nylon 6,12, and copolymers and blends thereof.

11. A multicolored effect yarn according to claim 9, wherein said polyester is selected from the group consisting of poly(ethylene terephthalate), poly(propylene terephthalate), poly(butylene terephthalate), poly (cyclohexane dimethanol terephthalate), poly(ethylene naphthalate), poly(propylene naphthalate), poly(ethylene succinate), poly(ethylene adipate), poly(hydroxybutryrate), poly(lactic acid), and copolymers and blends thereof.

12. A multicolored effect yarn according to claim 9, wherein said polyolefin is selected from the group consisting of polyethylene, polypropylene, and copolymers and blends thereof.

13. A multicolored effect yarn according to claim 1, wherein said multiplicity of said BCF singles yarns and said wrapper yarn are made from the same polymer.

14. A multicolored effect yarn according to claim 1, wherein said multiplicity of said BCF singles yarns are made from a different polymer to that used to make said wrapper yarn.

15. A multicolored effect yarn according to claim 1 wherein said core and wrapper the yarns are solution-dyed yarns.

16. A process for the manufacture of a multicolored effect yarn, comprising the steps of:

a) individually air-jet entangling a multiplicity of bulked continuous fiber (BCF) singles yarns having a denier between about 400 and about 1400 at between about 40 and about 80 entanglement points per meter and at a first degree of entanglement, wherein at least one of said BCF singles yarns is of a different color than any other of the said multiplicity of BCF singles yarns;

b) bringing together said multiplicity of individually air-jet entangled BCF singles yarns in a parallel bundle with substantially zero twist;

c) air-jet entangling said bundle at a second frequency and second degree of entanglement wherein said second frequency and said second degree of entanglement are both lower than said first frequency and said first degree of entanglement to form a core yarn of said multicolored effect yarn;

d) helically wrapping a wrapper yarn around said core yarn in a direct cabling device, wherein said wrapper yarn may be the same or differently colored than any of said multiplicity of said BCF singles yarns in said core, wherein the denier of said wrapper yarn is less than that of any of said BCF singles yarns; and e) winding up said multicolored effect yarn.

17. A process according to claim 16, wherein said multiplicity of singles yarns comprises between 2 and 8 of said singles yarns.

18. A process according to claim 16, wherein said BCF singles yarns are air-jet entangled such as to provide a degree of entanglement at said entanglement points of between about 75% and about 100%.

19. A process according to claim 18, wherein said multiplicity of said air-jet entangled BCF singles yarns are together air-jet entangled at between about 1 and about 2 entanglement points per meter.

20. A process according to claim 19, wherein said multiplicity of said air-jet entangled BCF singles yarns are air-jet entangled such as to provide a degree of entanglement at said entanglement points of between about 10% and about 25%.

21. A process according to claim 16, wherein said wrapper yarn is selected from the set of partially oriented yarns, flat drawn yarns and draw-textured yarns.

22. A process according to claim 21, wherein said wrapper yarn is a partially oriented yarn.

23. A process according to claim 21, wherein said wrapper yarn has a denier of between about 150 and about 250.

24. A process according to claim 16, wherein said multiplicity of said BCF singles yarns and said wrapper yarn are made from a melt-spinnable polymer selected from the group consisting of polyamides, polyesters and polyolefins.

25. A process according to claim 24, wherein said polyamide is selected from the group consisting of nylon 6, nylon 11, nylon 12, nylon 6,6, nylon 6,10, nylon 6,12, and copolymers and blends thereof.

26. A process according to claim 24, wherein said polyester is selected from the group consisting of poly(ethylene terephthalate), poly(propylene terephthalate), poly(butylene terephthalate), poly(ethylene adipate), poly(ethylene sebacate), poly(hydroxybutyrate), poly(lactic acid), and copolymers and blends thereof.

27. A process according to claim 24, wherein said polyolefin is selected from the group consisting of polyethylene, polypropylene, and copolymer and blends thereof.

28. A process according to claim 16, wherein said multiplicity of said BCF singles yarns and said wrapper yarn are made from the same polymer.

29. A process according to claim 16, wherein said multiplicity of said BCF singles yarns are made from a polymer different to that used to make said wrapper yarn.

30. A multicolored effect yarn according to claim 16 wherein said core and wrapper the yarns are solution-dyed yarns.

31. A carpet comprising at least one multicolored effect yarn comprising:

a) a core yarn consisting of a multiplicity of bulked continuous filament (BCF) singles yarns having a denier of about 400 to about 1400 wherein at least one of said BCF singles yarns is of a different color than any of the other BCF singles yarns and wherein each BCF singles yarn is individually air-jet entangled at between about 40 and about 80 entanglement points per meter and with a first degree of entanglement at said entanglement points, and wherein said multiplicity of individually air-jet entangled BCF singles yarns are subsequently air-jet entangled together at a second, lower, frequency of entanglement points and with a second, lower, degree of entanglement at said entanglement points, wherein said core exhibits substantially zero twist; and b) a wrapper yarn helically wound around said core yarn wherein said wrapper yarn is the same or differently colored than any of the said multiplicity of said BCF singles yarns in said core yarn and wherein the denier of said wrapper yarn is less than that of any of said multiplicity of said singles yarns in said core yarn.

32. A carpet according to claim 31, wherein core yarn and wrapper yarn of said multicoloured effect yarn are solution dyed yarns.

33. A multicolored effect yarn comprising:

a) a core yarn consisting of a multiplicity of bulked continuous filament (BCF) singles yarns, wherein at least one of said BCF singles yarns is of a different color than any of the other BCF singles yarns and wherein each BCF singles yarn is individually air-jet entangled at a first frequency of entanglement points and with a first degree of entanglement at said entanglement points and wherein said multiplicity of individually air-jet entangled BCF singles yarns are subsequently air-jet entangled together at a second, lower, frequency of entanglement points and with a second, lower, degree of entanglement at said entanglement points, wherein said core yarn exhibits substantially zero twist; and b) a wrapper yarn having a denier of about 150 to about 250 and helically wound at between about 40 and about 80 turns per meter around said core yarn, wherein said wrapper yarn is a partially oriented yarn which is the same or differently colored than any of the said multiplicity of said BCF singles yarns in said core yarn, and wherein the denier of said wrapper yarn is less than that of any of said multiplicity of said singles yarns in said core yarn.

34. A process for the manufacture of a multicolored effect yarn, comprising the steps of:

a) individually air-jet entangling a multiplicity of bulked continuous fiber (BCF) singles yarns at a first frequency and at a first degree of entanglement, wherein at least one of said BCF singles yarns is of a different color than any other of the said multiplicity of BCF singles yarns;

b) bringing together said multiplicity of individually air-jet entangled BCF singles yarns in a parallel bundle with substantially zero twist;

c) air-jet entangling said bundle at a second frequency and second degree of entanglement wherein said second frequency and said second degree of entanglement are both lower than said first frequency and said first degree of entanglement to form a core yarn of said multicolored effect yarn;

d) helically wrapping a wrapper yarn selected from the group consisting of partially oriented yarns, flat drawn yarns and draw-textured yarns around said core yarn in a direct cabling device at about 40 to about 80 turns per meter, wherein said wrapper yarn has a denier of about 150 to about 250 and may be the same or differently colored than any of said multiplicity of said BCF singles yarns in said core, wherein the denier of said wrapper yarn is less than that of any of said BCF singles yarns; and e) winding up said multicolored effect yarn.

35. A process for the manufacture of a multicolored effect yarn, comprising the steps of:

a) individually air-jet entangling a multiplicity of bulked continuous fiber (BCF) singles yarns at a first frequency and at a first degree of entanglement, wherein at least one of said BCF singles yarns is of a different color than any other of the said multiplicity of BCF singles yarns;

b) bringing together said multiplicity of individually air-jet entangled BCF singles yarns in a parallel bundle with substantially zero twist;

c) air-jet entangling said bundle at a second frequency and second degree of entanglement wherein said second frequency and said second degree of entanglement are both lower than said first frequency and said first degree of entanglement to form a core yarn of said multicolored effect yarn;

d) passing said core yarn through a direct cabling device at a tension at between 150 and 250 grams and helically wrapping a wrapper yarn around said core yarn in said direct cabling device, wherein said wrapper yarn may be the same or differently colored than any of said multiplicity of said BCF singles yarns in said core, wherein the denier of said wrapper yarn is less than that of any of said BCF singles yarns; and e) winding up said multicolored effect yarn.

* * * * *